US006782885B1

(12) United States Patent
Chiang et al.

(10) Patent No.: US 6,782,885 B1
(45) Date of Patent: Aug. 31, 2004

(54) SMOKE EXHAUSTER HAVING FORWARDED FAN CASING

(76) Inventors: Chao Cheng Chiang, P.O. Box 63-99, Taichung (TW), 406; Chi Shyong Chiang, P.O. Box 63-99, Taichung (TW), 406

( * ) Notice: Subject to any disclaimer, the term of this patent is extended or adjusted under 35 U.S.C. 154(b) by 0 days.

(21) Appl. No.: 10/636,444

(22) Filed: Aug. 5, 2003

(51) Int. Cl.[7] ..... F24C 15/20

(52) U.S. Cl. ..... 126/299 R; 126/299 D; 454/67

(58) Field of Search ..... 126/299 R, 299 D; 454/49, 67

(56) References Cited

U.S. PATENT DOCUMENTS 5,515,840 A * 5/1996 Jang ..... 126/299 R
5,775,319 A * 7/1998 Pettinari ..... 126/299 R
6,044,838 A * 4/2000 Deng ..... 126/299 D
6,214,073 B1 4/2001 Chiang et al. ..... 55/385.1
6,216,686 B1 * 4/2001 Chiu ..... 126/299 R
6,284,011 B1 9/2001 Chiang et al. ..... 55/471
2003/0056784 A1 * 3/2003 Yeung ..... 126/299 R

* cited by examiner

*Primary Examiner*—Harold Joyce

(57) ABSTRACT

A smoke exhauster includes a housing having an inclined plate extended forwardly and downwardly from an upper panel of the housing, a fan casing includes an upper panel secured to the upper plate of the housing to support one or more motors or fan devices, and includes a cut off portion formed in the front portion to receive the inclined plate of the housing and to allow the fan casing to be disposed forwardly relative to the housing, The fan casing and thus the fan device are disposed forwardly relative to the housing for allowing the fan device to effectively draw smoke or the like.

4 Claims, 7 Drawing Sheets

SMOKE EXHAUSTER HAVING FORWARDED FAN CASING

BACKGROUND OF THE INVENTION

1. Field of the Invention

The present invention relates to a smoke exhauster, and more particularly to a smoke exhauster having a fan casing that may be disposed in the front portion of the housing of the smoke exhauster, to effectively draw smoke or the like.

2. Description of the Prior Art

The applicant has developed various kinds of typical smoke exhausters which comprise a fan casing disposed in the inner and rear portion of the housing of the smoke exhauster, to receive one or more fan devices therein, and to draw smoke or the like out through the smoke exhausters.

For example, U.S. Pat. No. 6,214,073 B1, and U.S. Pat. No. 6,284,011 B1 to Chiang et al. disclose two of the typical smoke exhausters which also comprise a fan casing disposed in the inner and rear portion of the housing of the smoke exhauster, to receive one or more fan devices therein.

Normally, the housing of the smoke exhauster includes an inclined surface or panel disposed or arranged in the front portion thereof for supporting control panels, filter members, or other indicating lights. The fan casings normally include a parallelepiped structure that may only be disposed in the inner and rear portion of the housing of the smoke exhauster due to the inclined surfaces or panels that are disposed or arranged in the front portions of the housings of the smoke exhausters.

When the fan casings are disposed in the inner and rear portions of the housings of the smoke exhausters, the fan casings and thus the fan devices may only be disposed rearwardly relative to the cook stoves, and thus may not be uses to effectively draw the smoke or the like, as shown in FIG. 8.

The present invention has arisen to mitigate and/or obviate the afore-described disadvantages of the conventional smoke exhausters.

SUMMARY OF THE INVENTION

The primary objective of the present invention is to provide a smoke exhauster having a fan casing that may be disposed in the front portion of the housing of the smoke exhauster, to effectively draw smoke or the like.

In accordance with one aspect of the invention, there is provided a smoke exhauster comprising a housing including an upper plate, and an inclined plate extended forwardly and downwardly from the upper panel of the housing, a fan casing including an upper panel secured to the upper plate of the housing, and including a cut off portion formed in a front portion thereof to receive the inclined plate of the housing, and to allow the fan casing to be disposed forwardly relative to the housing, at least one motor including an upper board secured to the upper panel of the fan casing, and a fan device attached to the motor, and to be driven by the motor, an attachment of the fan casing forwardly relative to the housing allows the motor and the fan device to be disposed forwardly relative to the housing, and thus to allow the fan device to effectively draw smoke or the like.

The cut off portion of the fan casing is preferably defined by an inclined panel for engaging with the inclined plate of the housing, and having a slope identical to that of the inclined plate of the housing, to allow the inclined panel of the fan casing to be snugly engaged with the inclined plate of the housing, and thus to allow the fan device to be disposed forwardly relative to the housing.

The motor preferably includes a cut off portion disposed below the cut off portion of the fan casing, and preferably defined by an inclined board to engage with the inclined panel of the fan casing, to allow the motor to be further disposed forwardly relative to the housing.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
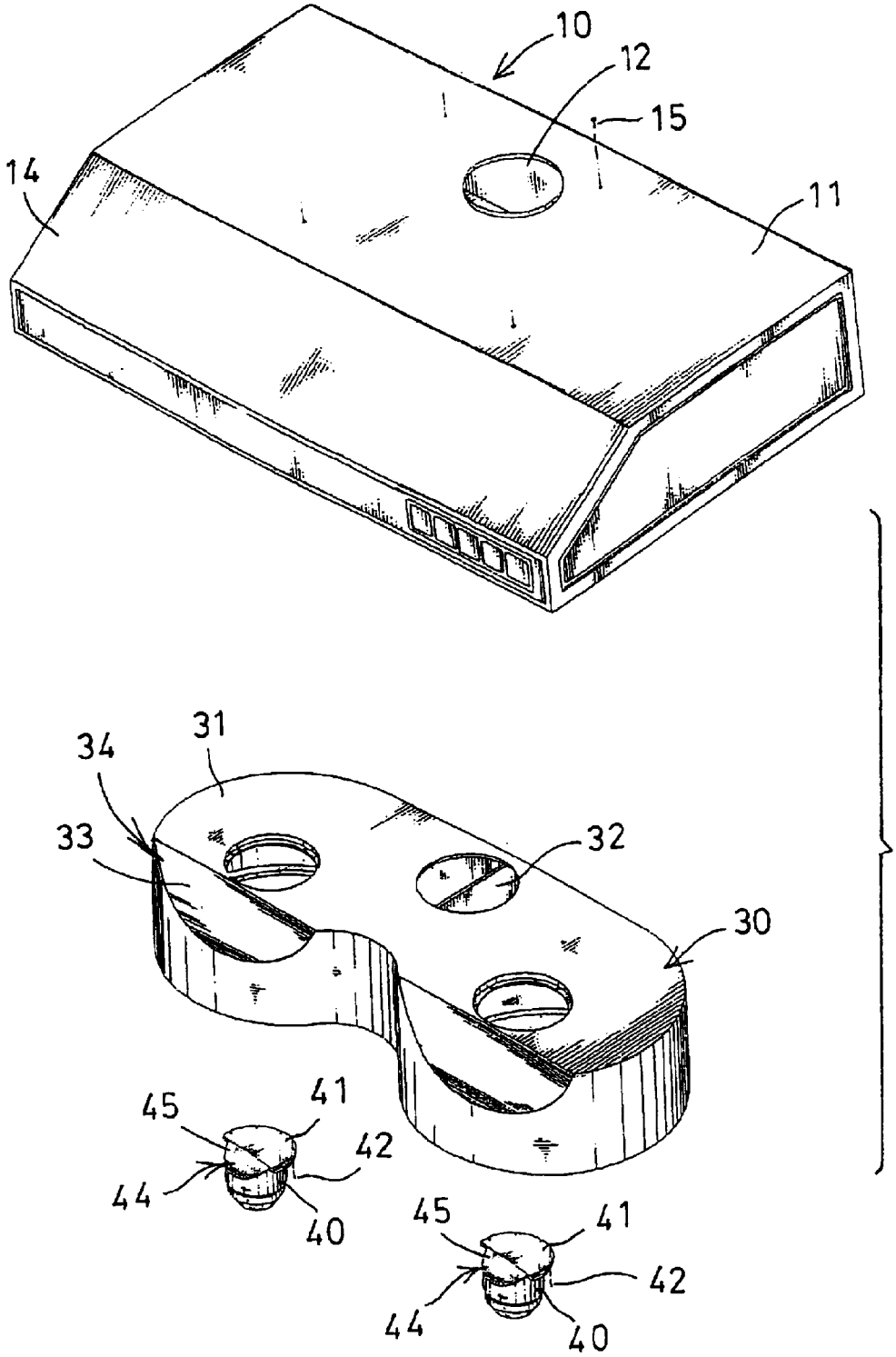
FIG. 1 is a partial exploded view of a smoke exhauster in accordance with the present invention.
Figure 2:
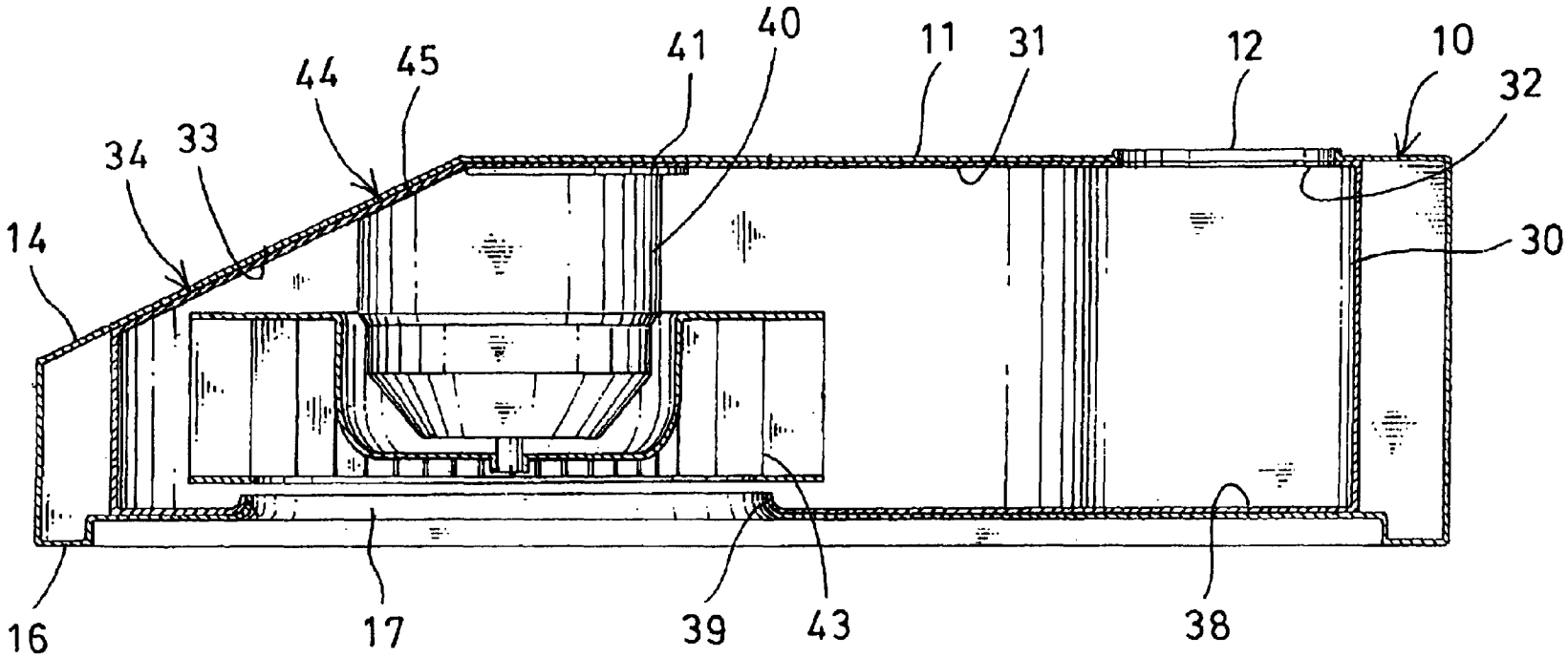
FIG. 2 is a cross sectional view of the smoke exhauster as shown in FIG. 1.

Referring to the drawings, and initially to FIGS. 1 and 2, a smoke exhauster in accordance with the present invention comprises a housing 10 including an upper plate 11 having one or more openings 12 formed therein for air circulation purposes, and an inclined plate 14 extended forwardly and downwardly from the upper panel 11. The housing 10 includes a bottom plate 16 having one or more passages 17 formed therein for air circulation purposes.

One or more fan casings 30 include an upper panel 31 secured to the upper plate 11 of the housing 10 with such as fasteners 15, and having one or more orifices 32 formed therein and aligned with the openings 12 of the housing 10 for air circulation purposes. The fan casings 30 include a bottom panel 38 to be contacted or engaged with the bottom plate 16 of the housing 10 and having one or more apertures 39 formed therein and aligned with the passages 17 of the housing 10 for air circulation purposes.

Figure 5:
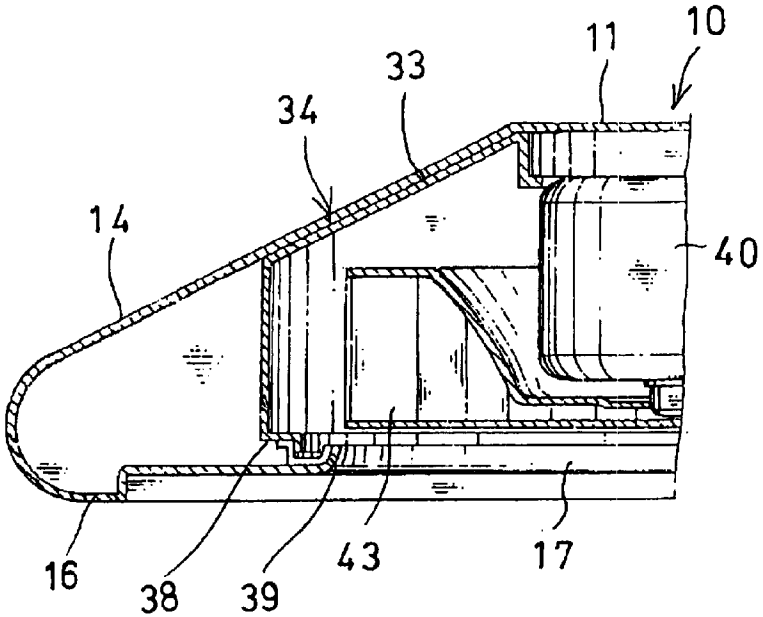
FIGS. 5, 6 are partial cross sectional views similar to FIGS. 2–4, illustrating the further arrangements of the smoke exhauster.
Figure 6:
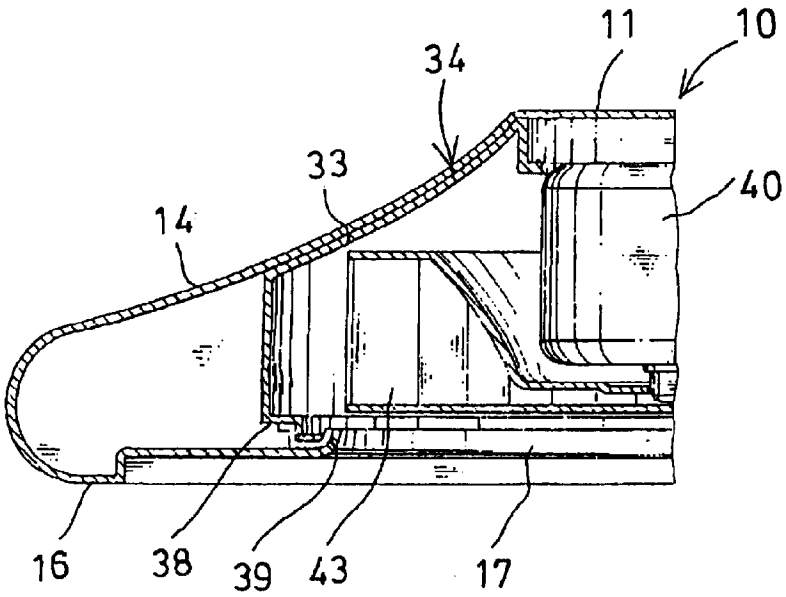

Each of the fan casings 30 includes a cut off portion 34 formed in the front portion thereof or defined by an inclined panel 33 which is extended forwardly and downwardly from the upper panel 31, and preferably having a slope or curvature identical to that of the inclined plate 14 of the housing 10, to receive the inclined plate 14 of the housing 10, and to allow the inclined panel 33 to be snugly engaged with or contacted with the inclined plate 14 of the housing 10, best shown in FIGS. 2, 5, 6.

In operation, as shown in FIGS. 4–7, the formation or the provision of the cut off portions 34 and/or the inclined panels 33 in the fan casings 30 allows the fan casings 30 and the passages 17 of the housing 10 to be disposed or arranged forwardly relative to the housing 10, and thus for allowing the fan casings 30 to be attached to the front portion of the housing 10.

One or more motors 40 include an upper board 41 secured to the upper panel 31 of the fan casing 30 with such as fasteners 42, and one or more fan devices 43 attached to the bottom thereof for being driven by the motors 40 to draw air through the orifices 32 of the fan casings 30 and the openings 12 of the housing 10.

As best shown in FIGS. 4–7, the attachment of the fan casings 30 to the front portion of the housing 10 allows the motors 40 to be attached or disposed in the front portion of the housing 10, and thus for allowing the motors 40 and the fan devices 43 to effectively draw smoke out through the orifices 32 of the fan casings 30 and the openings 12 of the housing 10.

Each of the motors 40 preferably includes a cut off portion 44 formed in the front portion thereof or defined by an inclined board 45 which is extended forwardly and downwardly from the upper board 41, and preferably having a slope identical to that of the inclined panel 33 of the fan casing 30, for allowing the cut off portion 44 of the motors 40 to be disposed below the cut off portion 34 of the fan casing 30.

The inclined board 45 of the motor 40 may thus be snugly engaged with or contacted with the inclined panel 33 of the fan casing 30, best shown in FIG. 2, thus for allowing the motors 40 to be attached to the front portion of the fan casing 30.

Figure 3:
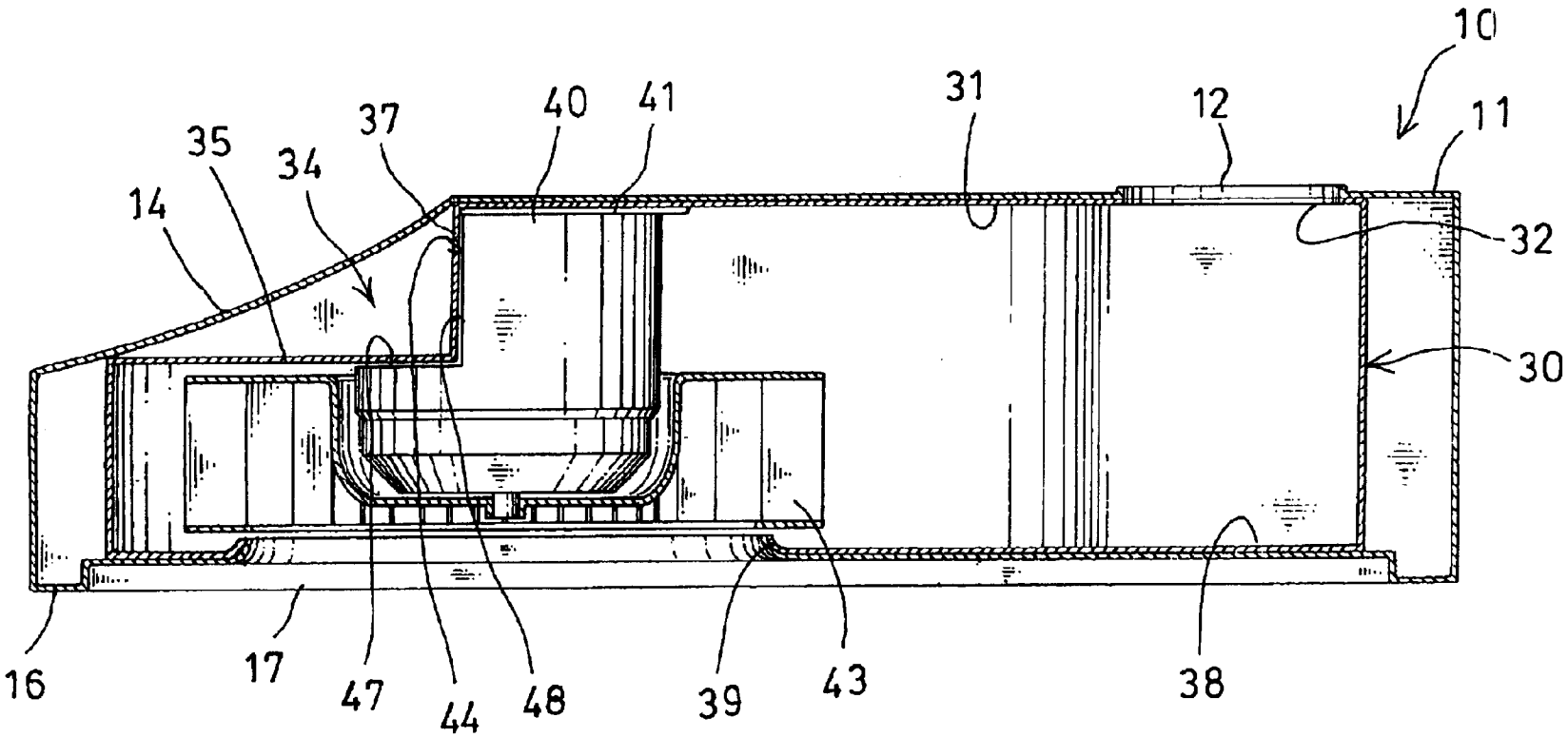
FIGS. 3, 4 are cross sectional views similar to FIG. 2, illustrating the other arrangements of the smoke exhauster.
Figure 4:
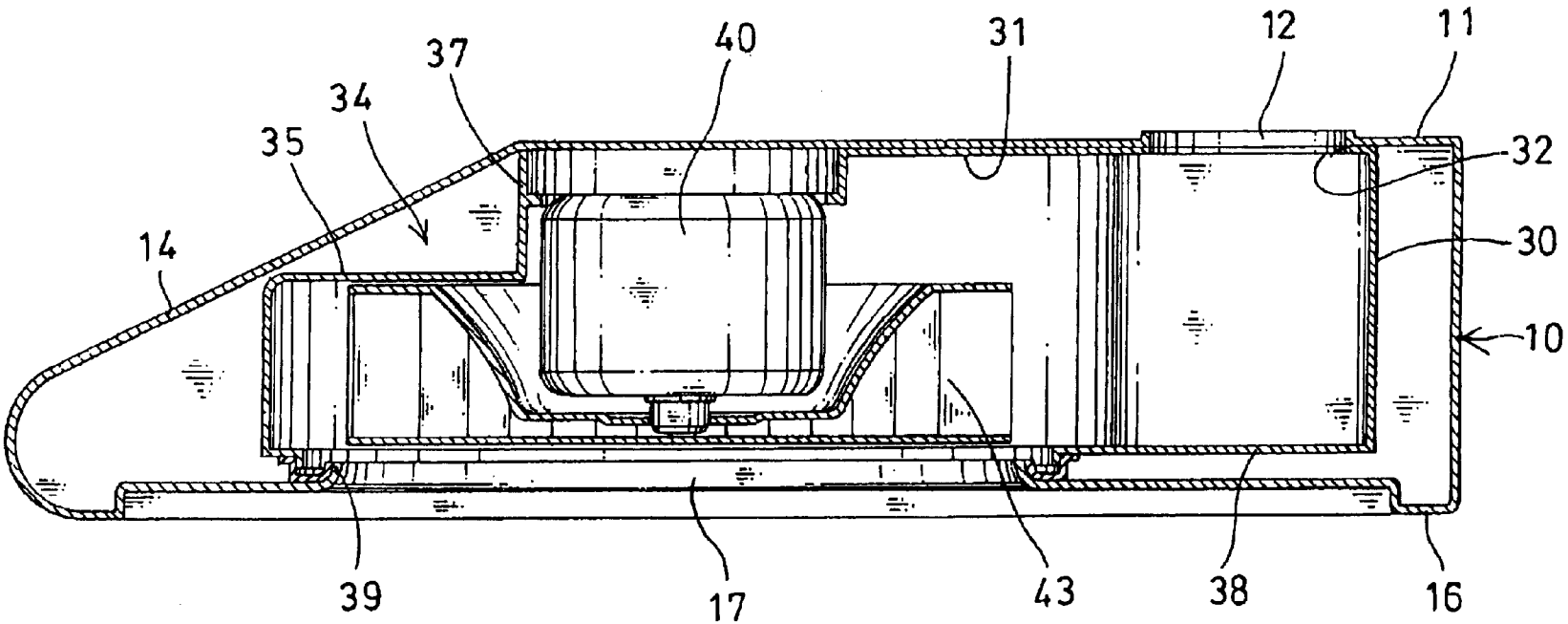

As shown in FIGS. 3 and 4, the cut off portions 34 of the fan casings 30 may also be formed or defined by a horizontal flap 35 and a vertical flap 37, instead of the inclined panel 33 of the fan casings 30, and thus may also be disposed or attached to the front portion of the housing 10.

As shown in FIG. 3, the cut off portions 44 of the motors 40 may also be formed or defined by a horizontal flap 47 and a vertical flap 48, instead of the inclined board 45 of the motors 50, to receive the inclined panel 33 of the fan casing 30 or the horizontal flap 35 and the vertical flap 37, and thus may also further be disposed or attached forwardly to the front portion of the fan casings 30 and thus to the front portion of the housing 10.

Figure 7:
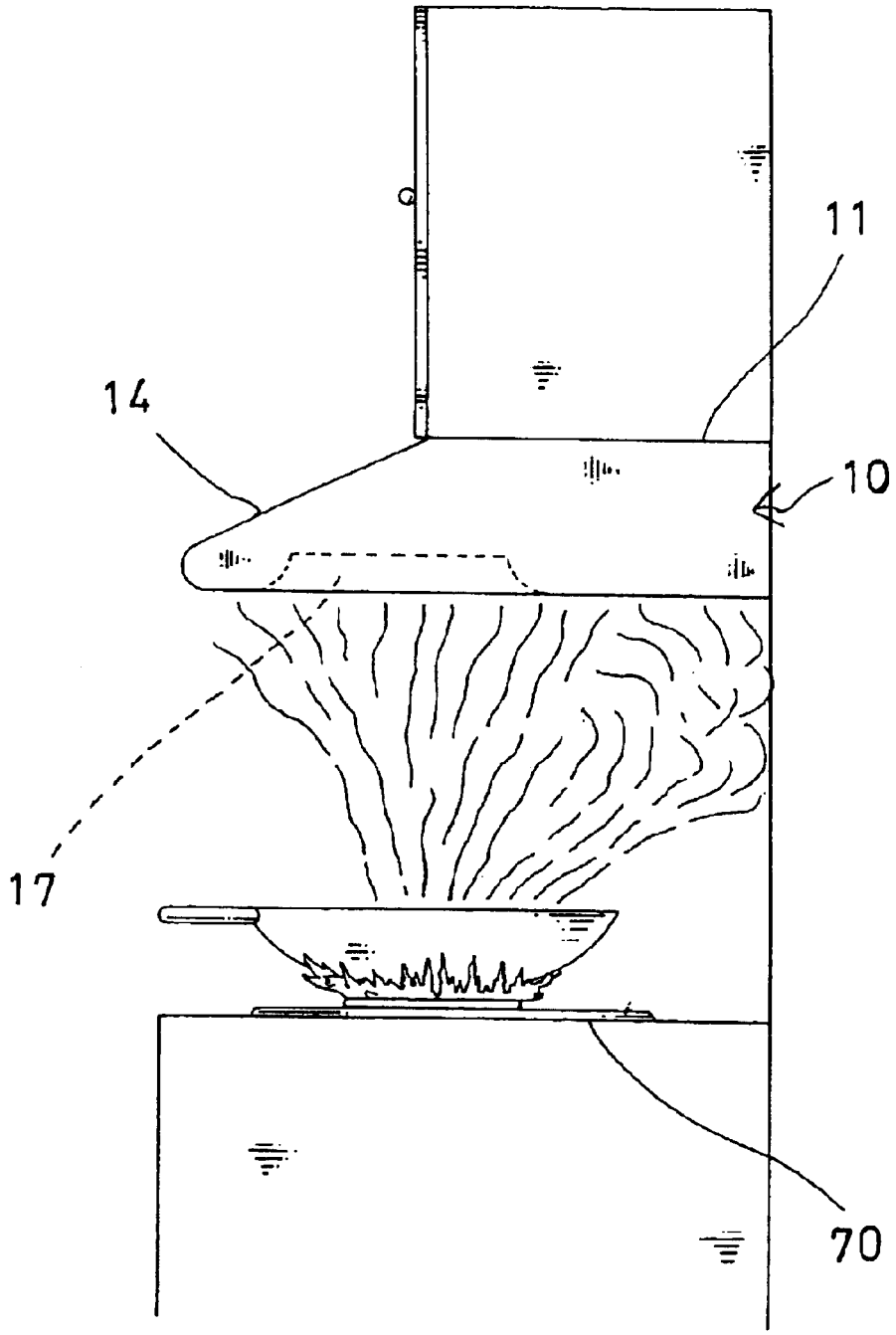
FIG. 7 is a side plan schematic view illustrating the operation of the smoke exhauster.
Figure 8:
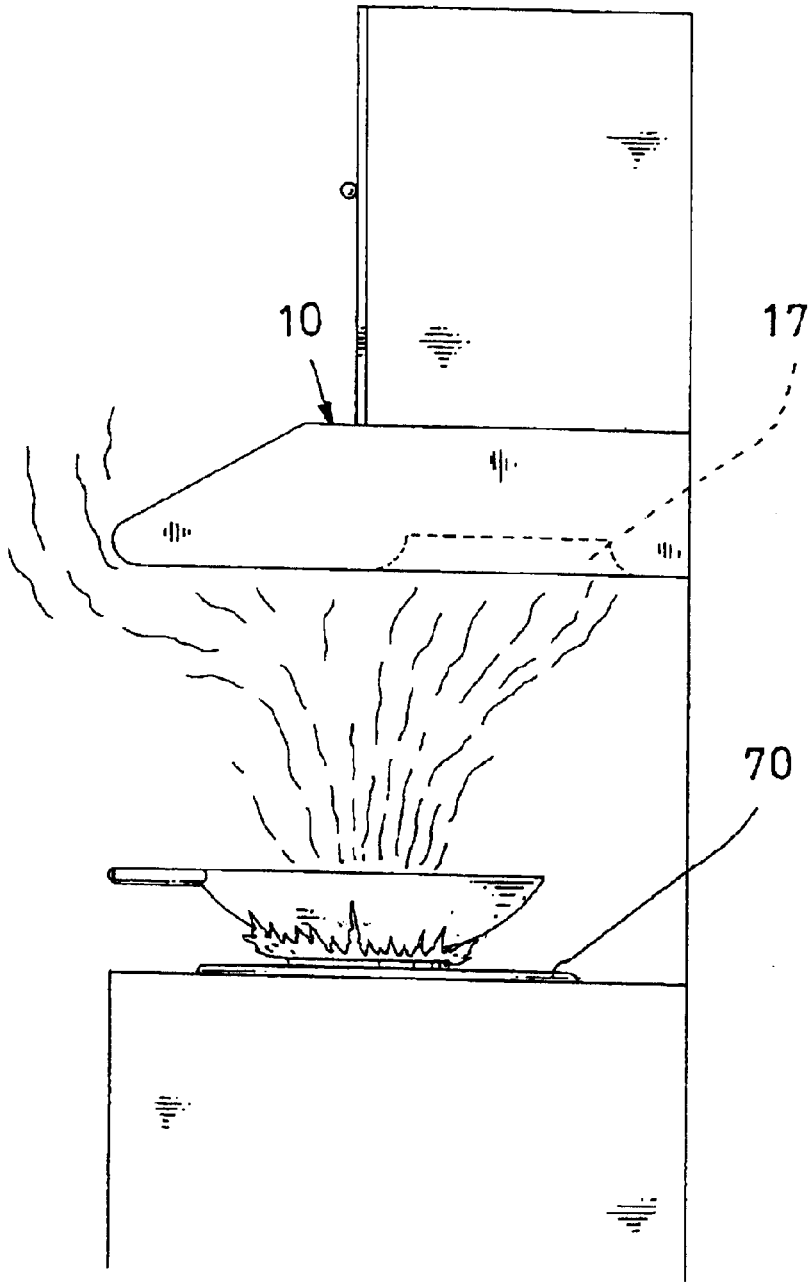
FIG. 8 PRIOR ART
FIG. 8 is a side plan schematic view illustrating the operation of a typical smoke exhauster.

In operation, as shown in FIG. 7, the attachment of the fan casings 30 and thus the motors 40 to the front portion of the housing 10 allows the motors 40 and the fan devices 43 and the passages 17 of the housing 10 to be disposed forwardly relative to the cooking stoves 70, or to be disposed right above the cooking stoves 70, to effectively draw smoke out through the orifices 32 of the fan casings 30 and the openings 12 of the housing 10.

Accordingly, the smoke exhauster in accordance with the present invention includes a fan casing that may be disposed in the front portion of the housing of the smoke exhauster, to effectively draw smoke or the like.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

What is claimed is:

1. A smoke exhauster comprising:

a housing including an upper plate, and an inclined plate extended forwardly and downwardly from said upper panel of said housing, a fan casing including an upper panel secured to said upper plate of said housing, and including a cut off portion formed in a front portion thereof to receive said inclined plate of said housing, said cut off portion of said fan casing being defined by an inclined panel to engage with said inclined plate of said housing, and to allow said fan casing to be disposed forwardly relative to said housing, at least one motor including an upper board secured to said upper panel of said fan casing, and a fan device attached to said at least one motor, and to be driven by said at least one motor, an attachment of said fan casing forwardly relative to said housing allows said at least one motor and said fan device to be disposed forwardly relative to said housing.

2. The smoke exhauster as claimed in claim 1, wherein said inclined panel of said fan casing includes a slope identical to that of said inclined plate of said housing, to allow said inclined panel of said fan casing to be snugly engaged with said inclined plate of said housing.

3. A smoke exhauster comprising:

a housing including an upper plate, and an inclined plate extended forwardly and downwardly from said upper panel of said housing, a fan casing including an upper panel secured to said upper plate of said housing, and including a cut off portion formed in a front portion thereof to receive said inclined plate of said housing, and to allow said fan casing to be disposed forwardly relative to said housing, at least one motor including an upper board secured to said upper panel of said fan casing, and including a cut off portion disposed below said cut off portion of said fan casing, to allow said at least one motor to be further disposed forwardly relative to said housing, and a fan device attached to said at least one motor, and to be driven by said at least one motor, an attachment of said fan casing forwardly relative to said housing allows said at least one motor and said fan device to be disposed forwardly relative to said housing.

4. The smoke exhauster as claimed in claims 3, wherein said cut off portion of said at least one motor is defined by an inclined board.

* * * * *